US006467782B1

(12) United States Patent
Smith

(10) Patent No.: US 6,467,782 B1
(45) Date of Patent: Oct. 22, 2002

(54) SKATEBOARD DEVICE

(76) Inventor: Marc Smith, 298 Green Lea Pl., Thousand Oaks, CA (US) 91361

( * ) Notice: Subject to any disclaimer, the term of this patent is extended or adjusted under 35 U.S.C. 154(b) by 0 days.

(21) Appl. No.: 09/693,169

(22) Filed: Oct. 23, 2000

(51) Int. Cl.[7] ..... A63C 17/28; F16B 39/10

(52) U.S. Cl. ..... 280/87.042; 280/11.28; 411/119

(58) Field of Search ..... 280/87.042, 87.043, 280/87.05, 87.01, 87.021, 87.03, 87.041, 11.27, 11.28; 411/119, 538

(56) References Cited

U.S. PATENT DOCUMENTS

| | | | | | |
|---|---|---|---|---|---|
| 2,155,827 | A | * | 4/1939 | Herold | 411/119 |
| 4,047,725 | A | * | 9/1977 | Pinchock | 280/87.042 |
| 4,103,917 | A | * | 8/1978 | Widolf | 280/87.042 |
| 4,166,629 | A | * | 9/1979 | List | 280/87.042 |
| 4,194,752 | A | * | 3/1980 | Tilch et al. | 280/87.042 |
| 4,251,087 | A | * | 2/1981 | Hansen | 280/87.042 |
| 4,311,319 | A | * | 1/1982 | Snyder et al. | 280/87.042 |
| 4,398,734 | A | * | 8/1983 | Barnard | 280/87.042 |
| 4,906,150 | A | * | 3/1990 | Bennett | 411/119 |
| 5,853,182 | A | * | 12/1998 | Finkle | 280/87.042 |
| 5,879,013 | A | * | 3/1999 | Shih | 280/87.042 |
| 6,027,293 | A | * | 2/2000 | Beemer et al. | 280/87.042 |
| 6,182,987 | B1 | * | 2/2001 | Bryant | 280/87.042 |
| 6,315,304 | B1 | * | 11/2001 | Kirkland et al. | 280/87.042 |
| 6,315,312 | B1 | * | 11/2001 | Reyes et al. | 280/87.042 |
| 6,367,819 | B1 | * | 4/2002 | Anderson et al. | 280/11.28 |

* cited by examiner

*Primary Examiner*—Paul N. Dickson
*Assistant Examiner*—Jeffrey Restifo
(74) *Attorney, Agent, or Firm*—Rapkin & Gitlin; Larry F. Gitlin, Esq.

(57) ABSTRACT

A device for use with a skateboard and a skateboard truck assembly to facilitate the removal and replacement of various component parts of a skateboard truck assembly including the bushings and the tension bolt, which is used to join the base plate and the axle assembly. The bolt, which is inserted through the aligned apertures in the axle assembly and the base plate, penetrates into the area beneath the base plate where it emerges and mates with the threaded nut. The device is supported by the bottom surface of the board and held stationary inside a pocket formed within the underside of the base plate and consists of integrally formed components including a generally flat base, a sloped guide platform situated upon the base, and an upstanding heel section formed at the base of the sloped guide platform. The guide platform is constructed according to a specific angle of inclination to fix the nut's orientation and to enable the nut and the threaded end of the bolt to properly align and engage. The upstanding heel section is provided to arrest the nut from deviating from its desired angle and position of alignment. Formed along the center portion of the heel section is a slight recess that aids in the proper positioning of the nut and to keep the nut immobile. Inside the pocket, which receives and generally conforms to the size and shape of the pedestal, is a hollow area, which holds the nut and keeps it confined to prevent rotation.

8 Claims, 3 Drawing Sheets

17
15
10
12
14
16

62
60
66
64
52
53
46
51
42
44
49
30
50
55
54
57
41
40
39
56
71
36
32
68
38
10
80
1A
72
20
84
82
22
70

SKATEBOARD DEVICE

BACKGROUND OF THE INVENTION

1. Field of the Invention

The present invention relates generally to the area of skateboards. More particularly, the invention regards a device employed in cooperation with a skateboard truck assembly to facilitate the removal and replacement of the tension bolt, which is also called the king pin, and the bushings.

2. Description of the Prior Art

A skateboard truck assembly in the prior art typically includes a base plate, which is connected directly to the underside (or bottom surface) of a skateboard, and an axle assembly to support the wheels, which is connected to the base plate. The base plate includes a bottom surface, which is generally flat, and raised mounts on the top surface to support the bushings and the axle assembly. The base plate and the axle assembly are secured to each other by a tension bolt with the use of a corresponding threaded nut, which engages and secures the bolt at the bolt's threaded end. The nut or the bolt is then rotated until tight.

Replacing a worn or broken bushing or bolt requires the removal of the bolt or the bushing and the installation of the replacement part. This process has always involved the difficult task of carefully aligning the bolt, as it penetrates through the apertures in the axle assembly and the base plate, with the threaded nut, which engages the bolt from below the base plate. Unfortunately, the nut is situated in an awkward position below the base plate. In this location, the nut is difficult to manipulate and align at the proper angle to enable it to effectively engage and secure the bolt. Thus, it has always been an essential, albeit time consuming, step in the process to totally remove the base plate from the skateboard. This enabled a person to gain easy access to the area beneath the plate to ensure the proper connection between the nut and the bolt.

In the past, skateboard truck assemblies typically employed a bolt with a rounded head and positioned the head end of the bolt underneath the base plate. The threaded nut mated with the threaded end of the bolt in the relatively exposed area where the bolt penetrates the axle assembly. There the nut and the bolt engaged to join and secure the base plate and the axle assembly. The perceived advantage with this arrangement was the ease in replacing a worn or broken part like the bushing, and then resecuring the assembly and the base plate to the board. The exposed area where the nut and the threaded end of the bolt were fastened gave easy access to the proper tool to tighten the nut and secure the connection. Still, replacing a worn or broken bolt required the cumbersome and time consuming task of removing both the base plate and the bolt, and then installing and resecuring all the parts. The threaded end of the bolt also tended to protrude beyond the axle and scrape along the running surface. This not only caused control problems with the board, but it was also considered a serious safety hazard. Thus, reversing the position of the bolt or inverting it to expose only the rounded or head end, which did not protrude, became an imperative. However, eliminating the need to remove and reconnect the base plate every time a bolt or bushing required replacement became the primary imperative. Still, the problem remained just how to ensure the proper alignment and positioning of the nut to make certain that the bolt would effectively engage the nut where it was situated in its concealed setting.

The present invention solves the problems in the prior art by providing an object similar in function to a pedestal, which is supported beneath the base plate, to hold and retain the threaded nut at a preselected angle to enable it to properly align with and engage the threaded end of the tension bolt. Also provided is a base plate, which includes the means to hold and confine the nut in a fixed position. Sculpted within the bottom surface of the base plate is an area generally conforming to the shape of the pedestal. Inside this area is a hollow where the nut is confined in a tight space and restrained from rotating. The tension bolt, upon engaging the restrained nut, is rotated until it tightens, thus securing the axle assembly and the base plate to the skateboard. When the bolt is removed to allow for its replacement, or the bolt is removed to replace a worn or defective bushing, the threaded nut remains seated on the pedestal at the desired angle and fixed inside the hollow to prevent rotation.

SUMMARY OF THE INVENTION

The present invention provides a device for use with a skateboard and a skateboard truck assembly to facilitate the removal and replacement of various component parts of a skateboard truck assembly including the bushings and the tension bolt, which is used to join the base plate and the axle assembly. The bolt is inserted through the aligned apertures in the axle assembly and the base plate. It then penetrates into the area beneath the base plate where it emerges and mates with the threaded nut. The invention includes a device which is supported by the bottom surface of the board and held stationary inside a pocket formed within the underside of the base plate. The device, which is referred to as a pedestal, includes a generally flat base, a sloped guide platform situated upon the base, and an upstanding heel section formed at the base of the sloped guide platform. The guide platform is constructed according to a specific angle of inclination to fix the nut's orientation and to enable the nut and the threaded end of the bolt to properly align and engage. The upstanding heel section acts like a retaining wall provided to arrest the nut from deviating from its desired angle and position of alignment. Formed along the center section of the inside surface of this wall is a slight recess that aids in the proper positioning of the nut and to keep the nut immobile. Inside the pocket, which receives and conforms to the size and shape of the pedestal, is a hollow area, which holds the nut and keeps it confined to prevent rotation.

Accordingly, an object of the present invention is to provide a device which is used in conjunction with a skateboard truck assembly to facilitate the removal and reinsertion of the tension bolt and the bushings.

Another object of the present invention is to provide a device which is used in conjunction with a skateboard truck assembly that enables the removal and reinsertion of the tension bolt and the bushings without requiring the removal of the base plate from the skateboard.

Another object of the present invention is to provide a device which is used in conjunction with a skateboard truck assembly that holds a threaded nut stationary at the desired angle of inclination to enable the tension bolt and the nut to align properly and engage.

Still another object of the present invention is to provide a device which is resilient and is used in conjunction with a skateboard truck assembly to inhibit or prevent the slippage of the mounting plate across the surface of the skateboard.

Still another object of the present invention is to provide a device which is used in conjunction with a skateboard truck assembly that absorbs the shock of the forces generated through the tension bolt sustained in the act of skateboarding.

Still another object of the present invention is to provide an apparatus which is used in conjunction with a skateboard truck assembly to restrain the nut from rotating when the tension bolt and the nut engage.

Still another object of the present invention is to provide a device that is cost effective and easily and efficiently manufactured.

Other objects and advantages of the present invention will become apparent in the following specifications when considered in light of the attached drawings wherein the preferred embodiment of the invention is illustrated.

DETAILED DESCRIPTION OF THE PREFERRED EMBODIMENT

Figures 1, 1A:
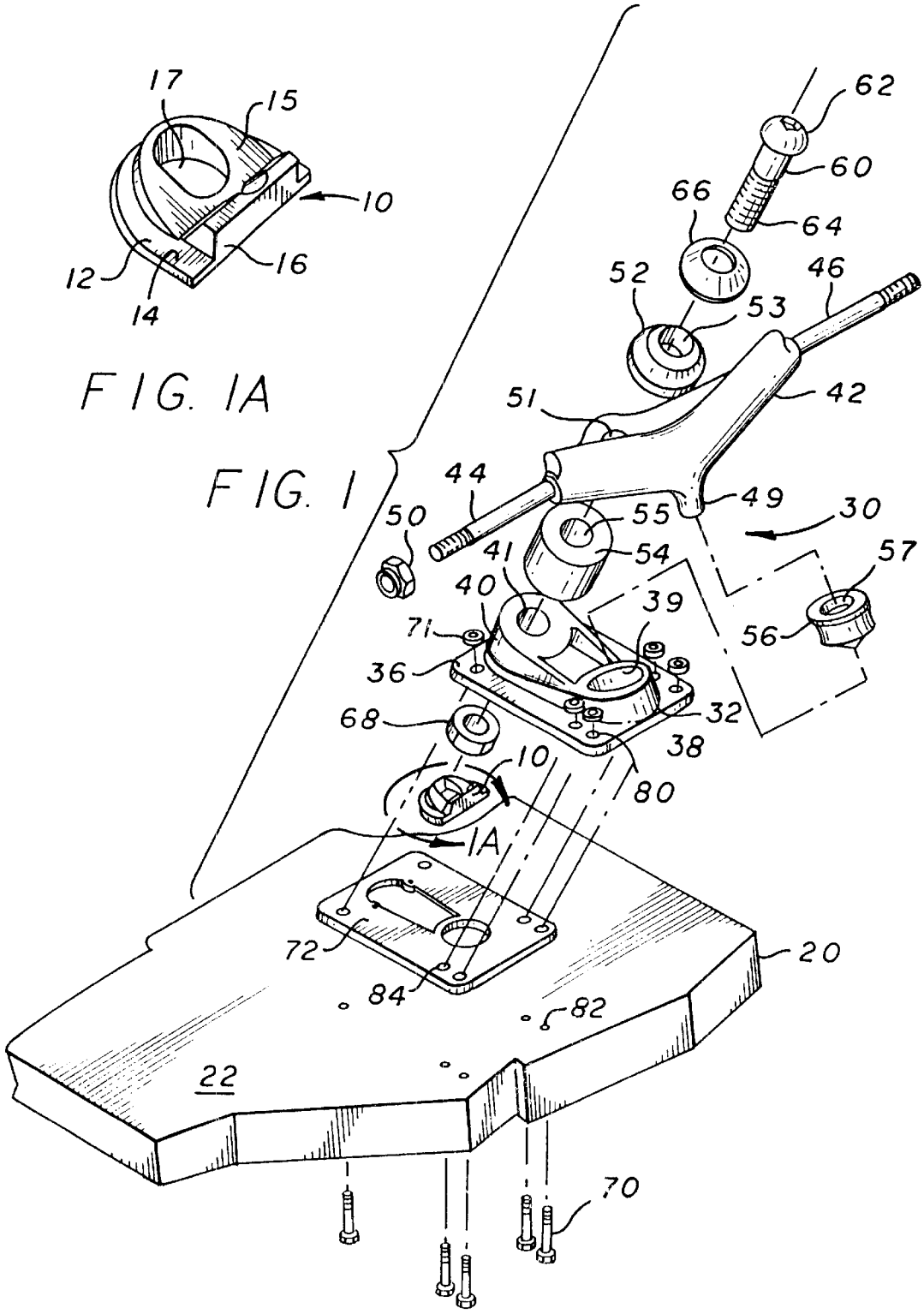
FIG. 1 is an exploded view of the components of a skateboard truck assembly showing the device and the other elements of the present invention in connection therewith.
FIG. 1A is an enlarged perspective view of the device of the present invention.
Figure 2:
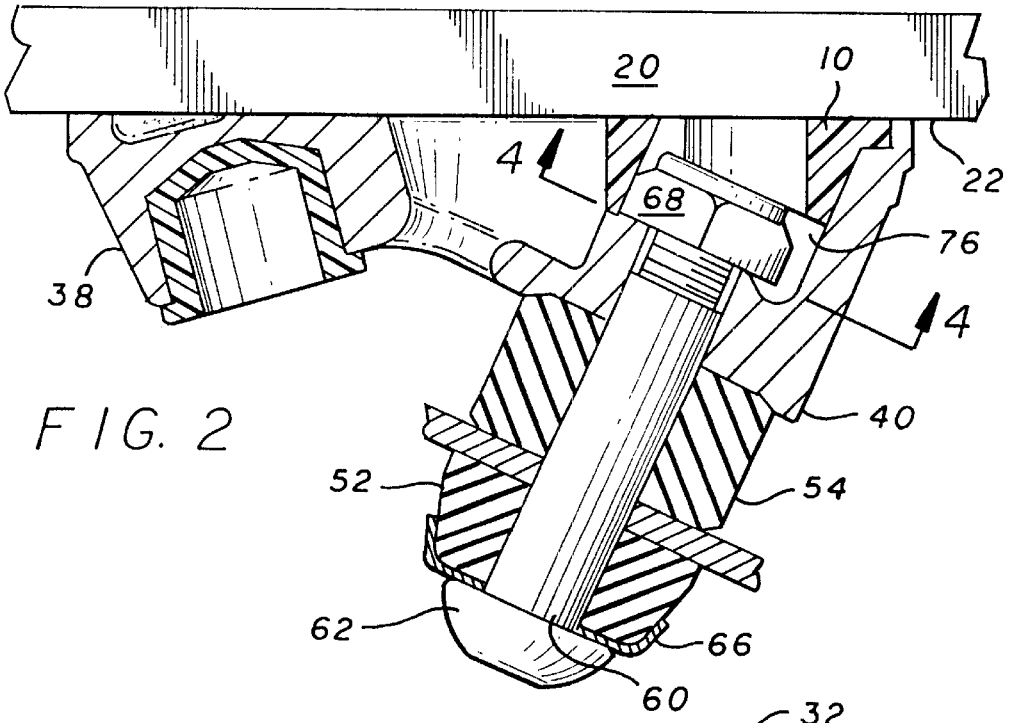
FIG. 2 is a cross-sectional view of the device and the other components of the present invention shown in relation to a skateboard truck assembly.
Figure 3:
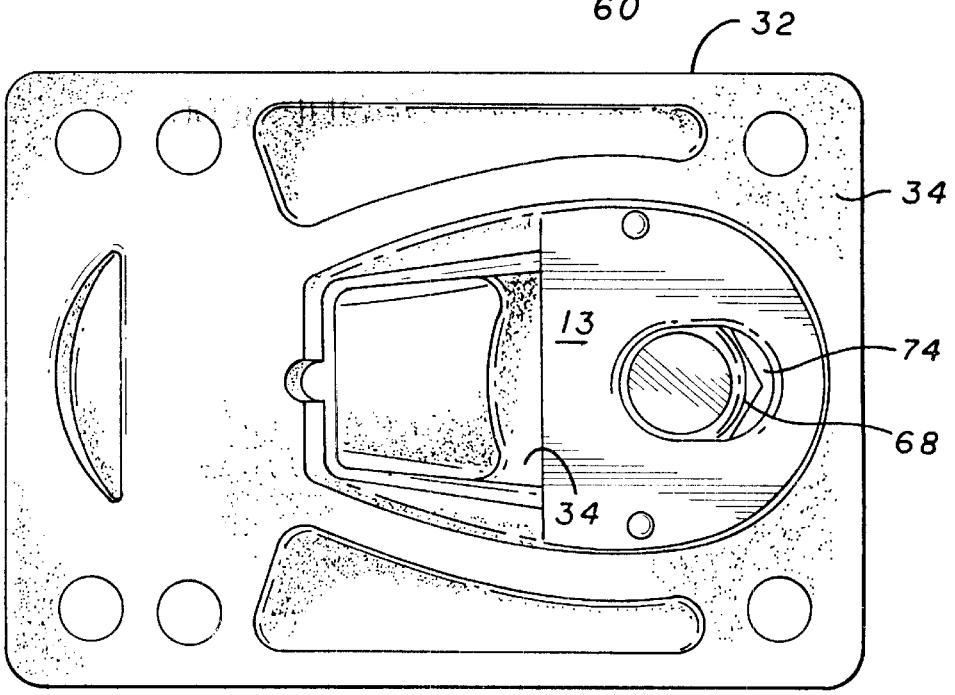
FIG. 3 is a bottom view of the base plate component of the skateboard truck assembly with the device of the present invention shown situated inside the pocket formed within the underside of the plate.
Figure 4:
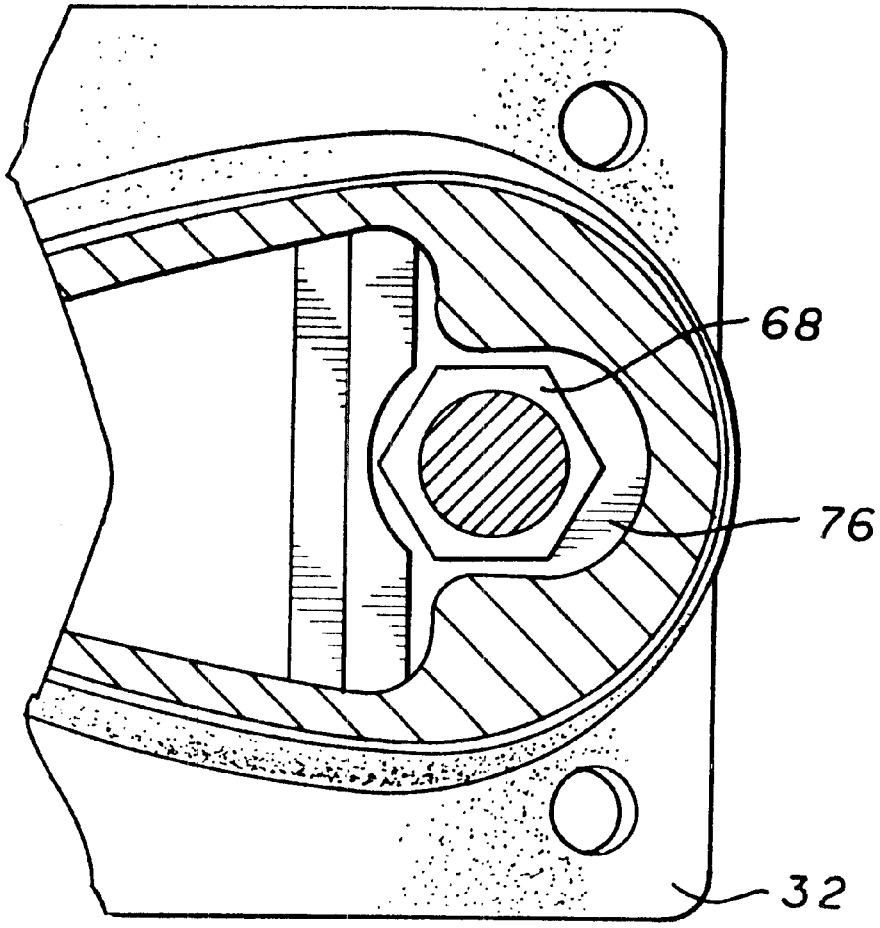
FIG. 4 is a sectional view of the device in accordance with the present invention shown along line 4—4 of FIG. 2.

Referring more particularly to the drawings, FIG. 1A is an enlarged perspective view of pedestal 10 of the present invention. In FIG. 1, pedestal 10 is shown in combination with a section of a skateboard 20 and the various components of skateboard truck assembly 30. Pedestal 10 is an object typically constructed of a synthetic substance (e.g. neoprene) or, if desired, any natural material (e.g. rubber). It can be flexible and resilient, but is not restricted to these characteristics. Pedestal 10 comprises integral components including an arcuately shaped base section 12 with a flat bottom surface 13 and an upper surface 14, a sloped guide platform 15, which is integrally mounted on the base 12, and an upstanding heel piece 16 integrally formed at the base of the sloped guide platform 15. Aperture 17 is formed within the center of the sloped guide platform 15.

Skateboard 20 has an upper surface (not shown) and a bottom surface 22 upon which a pair of skateboard truck assemblies (e.g. assembly 30) are mounted. Truck assembly 30 includes a base plate 32 having a bottom surface 34 and a top surface 36. Formed within the top surface 36 are bushing mounts 38 and 40 with apertures 39 and 41 therein, respectively. Axle assembly 42 includes the wheel axles 44 and 46 for mounting the wheels (not shown), a spur 49 and an aperture 51. Threaded nuts 50 are provided to secure the wheels to the axles 44 and 46. Axle assembly 42 joins with base plate 32 by aligning apertures 41 and 51 and inserting spur 49 into aperture 39. Bushings 52, 54 and 56 are provided for structural support and shock absorption. Bushing 52 includes aperture 53; bushing 54 includes aperture 55; bushing 56 includes aperture 57.

The two principal components of truck assembly 30 are then secured using a tension bolt 60, which includes a head end 62, usually rounded, and a threaded end section 64. A washer 66 is also provided. Bolt 60 is inserted through washer 66 and aligned apertures 41, 51, 53 and 55 and engages threaded nut 68. Using the appropriate tool, bolt 60 is then rotated until tight. Truck assembly 30 is attached to the bottom surface 22 of skateboard 20 using any suitable means for this purpose, such as bolts 70 and nuts 71 inserted through apertures 80 in base plate 32 and apertures 82 in skateboard 20.

If it becomes necessary to increase the height of the truck assembly 30 relative to the skateboard surface 22 to accommodate larger wheels, a riser 72 may be provided. Apertures 84 are provided to receive bolts 70 to secure riser 72 between base plate 32 and board 20. Riser 72 also acts as a means for shock absorption.

In practice, threaded nut 68 is placed inside pocket 74, which is sculpted within bottom surface 34 of base plate 32, and then immediately inserted into hollow 76, which is formed within pocket 74. Hollow 76, which conforms generally to the shape and physical dimensions of threaded nut 68, holds the nut fixed and prevents it from rotating. In this position, threaded nut 68 can properly engage bolt 60, which is then rotated until the connection between the two is tight and the truck assembly 30 is secured. Pedestal 10 is positioned inside pocket 74, which conforms to the pedestal's size and shape to ensure a secure fit. Base plate 32 is then mounted to the skateboard surface 22, which has the effect of securing and confining pedestal 10 and threaded nut 68 situated in the hollow immediately adjacent.

When bolt 60 is removed to enable the replacement of a worn or broken bushing or bolt, threaded nut 68 remains fixed within the confines of hollow 76, where its previous alignment is preserved. When bolt 60 is reinserted, it easily engages the threaded nut 68 and, after sufficient rotation, the connection between the bolt and the nut is again tight and secure. During the entire process, the nut never deviates from its proper alignment, positioning or angle of inclination. Moreover, it never becomes necessary during this process, as it was with the prior art devices, to separate the base plate 32 from the board to gain access to the nut to enable it to engage and secure the bolt.

While the invention will be described in connection with a certain preferred embodiment, it is to be understood that it is not intended to limit the invention to that particular embodiment. Rather, it is intended to cover all alternatives, modifications and equivalents as may be included within the spirit and scope of the invention as defined by the appended claims.

What is claimed is:

1. In combination with a skateboard and a skateboard assembly, a mounting bracket, a mounting plate included therewith for affixing said skateboard assembly to the underside of said skateboard, said mounting plate having an underside with a partially recessed area therein, an axle assembly, said axle assembly and said mounting member having aligned apertures therethrough, a threaded tension bolt disposed through said aligned apertures for joining said mounting member and said axle assembly, and a threaded nut to engage said tension bolt; and, a means adapted to fit within said partially recessed area for engaging and securely seating said threaded nut in axial alignment with said tension bolt penetrating said apertures to enable the bolt to threadably engage said threaded nut and facilitate the installation and securement of said tension bolt.

2. The invention of claim 1 wherein said means within said partially recessed area comprises a pedestal member, a generally flat base integrally formed therewith, a sloped guide platform integrally formed with said base, said sloped guide platform having an upper end and a lower end, and an upstanding heel member formed integrally with said base member along the lower end of said sloped guide platform.

3. The invention of claim 1 wherein said partially recessed area includes a pocket portion generally conformable to the shape of said threaded nut for rotatively fixing said threaded nut.

4. The invention of claim 1 including a means fixedly situated between said underside of said skateboard and said mounting plate to inhibit the slippage of said mounting plate across the underside of said skateboard.

5. The invention of claim 2 wherein said upstanding heel includes a recessed area to assist in the proper positioning of said threaded nut in aligned relation with said tension bolt.

6. The invention of claim 1 including bushing members provided to absorb the shock of compressive forces exerted through the tension bolt in conjunction with the act of skateboarding.

7. In combination with a skateboard and a skateboard assembly, a mounting member for affixing said skateboard assembly to the underside of said skateboard, said mounting member having an underside with a recessed area therein, an axle assembly, said axle assembly and said mounting member having aligned apertures therethrough, a threaded tension bolt disposed through said aligned apertures for joining said mounting member and said axle assembly, and a threaded nut to engage said tension bolt; and, a means with a sloping upper surface adapted to fit within said recessed area for engaging and securely seating said threaded nut in axial alignment with said tension bolt penetrating said apertures to enable the bolt to threadably engage said threaded nut and facilitate the installation and securement of said tension bolt.

8. In combination with a skateboard and a skateboard assembly, a mounting bracket with a mounting plate for affixing said assembly to the underside of said skateboard, and an axle assembly, said mounting bracket and axle assembly having apertures therethrough for receiving a threaded tension bolt for affixing said mounting bracket and said axle assembly to said skateboard and a threaded nut to engage said bolt, a means fitted beneath the mounting plate for engaging said threaded nut and positioning said nut and seating it at an angle in aligned relation with the longitudinal axis of said tension bolt penetrating the apertures of said axle assembly and said mounting bracket to facilitate the removal and replacement of said tension bolt.

* * * * *